US012781410B2

(12) United States Patent
Pollett

(10) Patent No.: US 12,781,410 B2
(45) Date of Patent: Nov. 3, 2026

(54) WASHING MACHINE APPLIANCE STEAM OPTION SELECTION

(71) Applicant: Haier US Appliance Solutions, Inc., Wilmington, DE (US)

(72) Inventor: James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 246 days.

(21) Appl. No.: 18/364,895

(22) Filed: Aug. 3, 2023

(65) Prior Publication Data

US 2025/0043484 A1 Feb. 6, 2025

(51) Int. Cl.

| | |
|---|---|
| ***D06F 34/28*** | (2020.01) |
| ***D06F 39/04*** | (2006.01) |
| ***D06F 39/08*** | (2006.01) |

(52) U.S. Cl.

CPC ..... *D06F 34/28* (2020.02); *D06F 39/04* (2013.01); *D06F 39/08* (2013.01)

(58) Field of Classification Search

None

See application file for complete search history.

(56) References Cited

U.S. PATENT DOCUMENTS

| | | | |
|---|---|---|---|
| 7,565,822 | B2 | 7/2009 | Park et al. |
| 7,797,969 | B2 | 9/2010 | Park et al. |
| 9,611,579 | B2 | 4/2017 | Brasseur et al. |
| 2009/0044577 | A1 | 2/2009 | Lee |

FOREIGN PATENT DOCUMENTS

| | | | |
|---|---|---|---|
| CN | 115517605 | A | 12/2022 |
| KR | 100917827 | B1 | 9/2009 |

OTHER PUBLICATIONS

Development of a Carbon Nanotube-Based Touchscreen Capable of Multi-Touch and Multi-Force Sensing, Sensors Journal, by Wonhyo Kim, Haekwan Oh, Yeonhwa Kwak, Kwangbum Park, Byeong-Kwon Ju and Kunnyun Kim (Year: 2015).*

* cited by examiner

*Primary Examiner* — Rita P Adhlakha

(74) *Attorney, Agent, or Firm* — Dority & Manning, P.A.

(57) ABSTRACT

A washing machine appliance includes a wash tub, a wash basket rotatable mounted within the tub, and a heating element in thermal communication with the wash tub such that the heating element is positioned and configured to generate steam within the wash tub. A method of operating the washing machine appliance includes receiving a cycle selection and a steam option selection from the same input selector. The method also includes activating the heating element during the selected cycle of the washing machine appliance in response to the received steam option selection.

20 Claims, 7 Drawing Sheets

WASHING MACHINE APPLIANCE STEAM OPTION SELECTION

FIELD OF THE INVENTION

The present subject matter relates generally to washing machine appliances, and more particularly to systems and methods for selecting a steam option in one or more selectable cycles of such washing machine appliances.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Some washing machine appliances include features for generating steam within the washing machine appliance, such as to treat articles in the washing machine appliance, e.g., in a washing cycle with a steam option. Such washing machine appliances typically include complex selection mechanisms or indicators, such as separate selectors for a cycle and for the steam option for one or more cycles.

As a result, further advances are desired in the art to improve systems and methods for selecting steam options of washing machine appliances and informing users of the selected cycle and option.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance has a cabinet, a wash tub positioned within the cabinet, and a wash basket rotatably mounted within the wash tub. The washing machine appliance further includes a heating element in thermal communication with the wash tub such that the heating element is positioned and configured to generate steam within the wash tub. A control panel of the washing machine appliance includes a plurality of input selectors and a display. One input selector of the plurality of input selectors is configured to output a cycle selection and a steam option selection. The washing machine appliance also includes a controller. The controller is configured for receiving a cycle selection and a steam option selection from the one input selector of the plurality of input selectors. The controller is also configured for activating the heating element during the selected cycle of the washing machine appliance in response to the received steam option selection.

In another exemplary aspect of the present disclosure, a method of operating a washing machine appliance is provided. The washing machine appliance has a cabinet, a wash tub positioned within the cabinet, and a wash basket rotatably mounted within the wash tub. The washing machine appliance further includes a heating element in thermal communication with the wash tub such that the heating element is positioned and configured to generate steam within the wash tub. A control panel of the washing machine appliance includes a plurality of input selectors and a display. The method includes outputting, by one input selector of the plurality of input selectors, a cycle selection and a steam option selection. The method further includes receiving the cycle selection and the steam option selection by a controller of the washing machine appliance. The method also includes activating the heating element during the selected cycle of the washing machine appliance in response to the received steam option selection.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
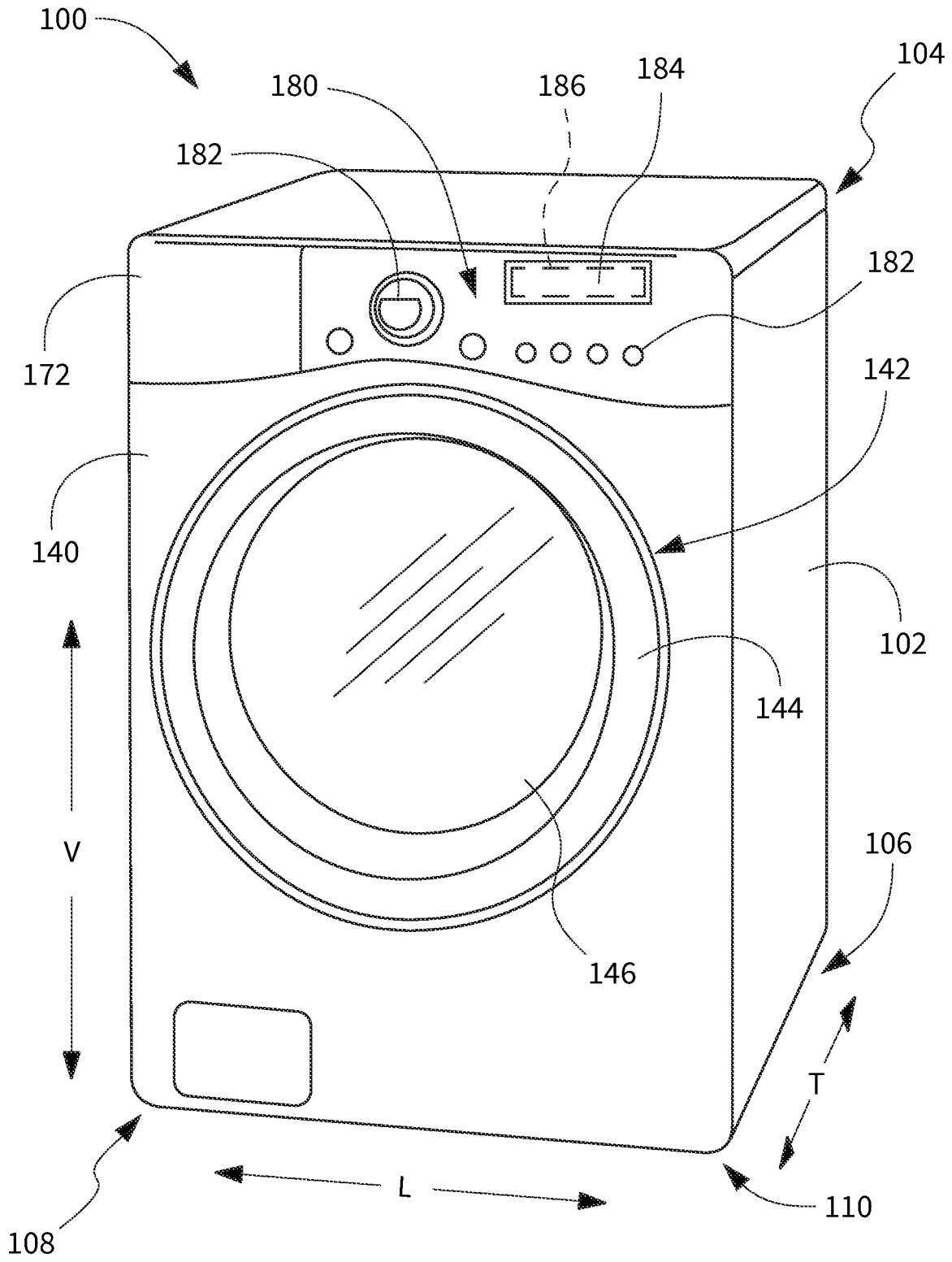
FIG. 1 provides a perspective view of a washing machine appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "generally," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Figure 2:
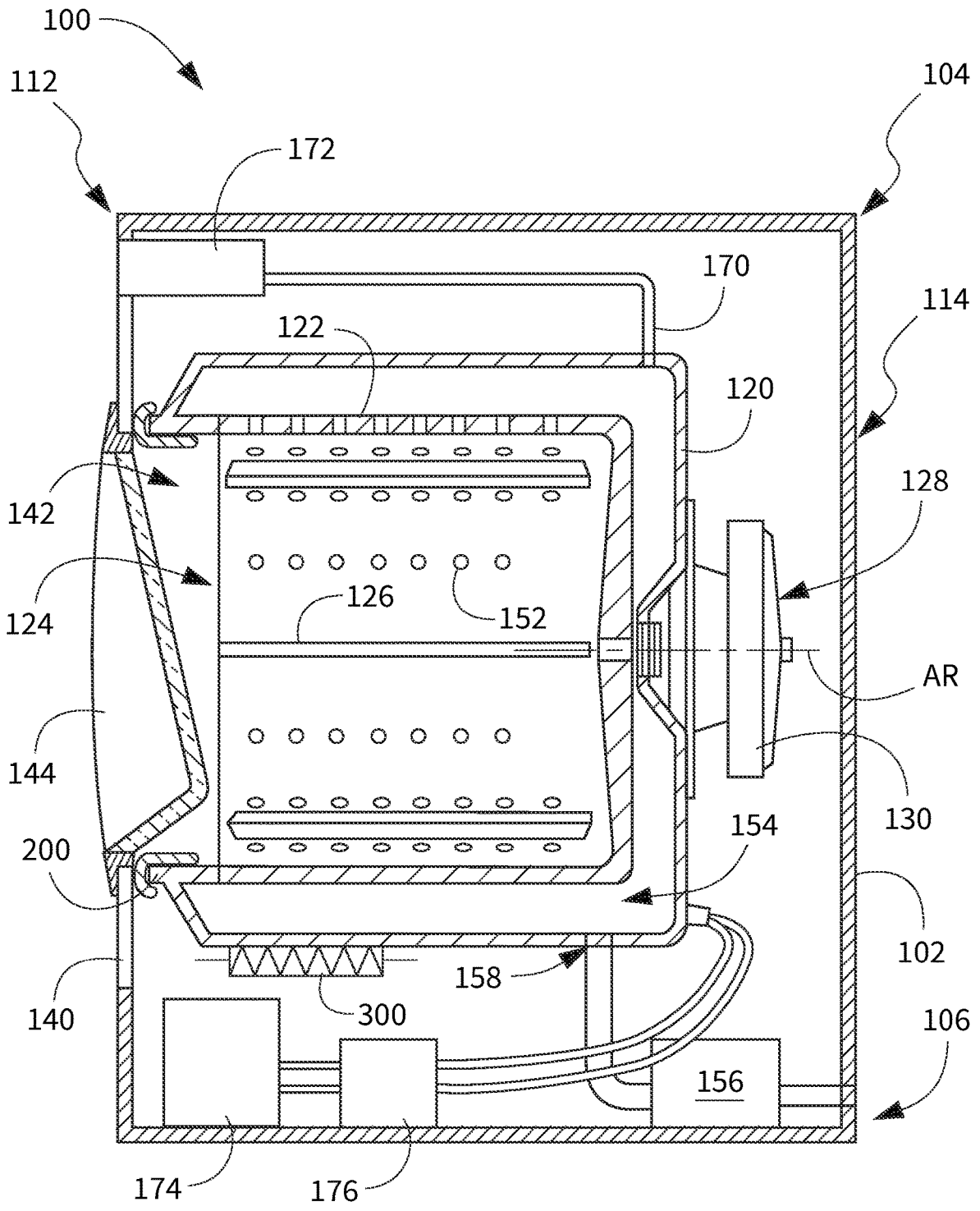
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L. and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" or "wash liquid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. A gasket 200 may be provided in the opening 142 and the gasket 200 may sealingly engage the door 144 when the door 144 is in the closed position. For example, the gasket 200 may extend between the tub 120 and the front panel 140, e.g., generally along the transverse direction T and may extend about or around the opening 142 such that the gasket 200 is covered by the door 144 when the door 144 is in the closed position, and the gasket 200 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump and/or a circulation pump.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. A display 184 of control panel 180 indicates selected features, operation mode, a countdown timer, and/or other items of interest to appliance users regarding operation. The input selectors 182 may include one or more knobs, buttons, switches, touchpads, or touchscreens, e.g., the display 184 or a portion thereof may be an interactive display including touch-responsive features, such as a capacitive touch sensor. Control panel 180 and input selectors 182 collectively form a user interface for operator selection of machine cycles and features.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In addition, the memory or memory devices of the controller 186 can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases and/or may be split up so that the data is stored in multiple locations. In addition, or alternatively, the one or more database(s) can be connected to controller 186 through any suitable network(s), such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, the gasket 200 may help to contain wash fluid within the cabinet 102, particularly within the tub 120. As generally shown in FIG. 2, the gasket 200 may be positioned between the door 144 and the tub 120, e.g., when the door 144 is in the closed position as in FIG. 2. Thus, the gasket 200 may sealingly engage the door 144 when the door 144 is in the closed position. In general, the gasket 200 sealingly engages the cabinet 102, in particular the opening 142 thereof, the tub 120, and the door 144. For example, the gasket 200 may extend around the opening 142 along a perimeter, e.g., circumference, of the opening 142 and may extend between the cabinet 102 and the wash tub 120 along a longitudinal axis, such as along or generally parallel to the transverse direction T.

Also as may be seen in FIG. 2, the washing machine appliance 100 may further include a heater 300 in thermal communication with the wash tub 120. The heater 300 is in thermal communication with the wash tub 120 such that, when the heater 300 is activated, wash liquid in the wash tub 120 is heated and may thereby generate steam. Such steam generation may be useful, for example, to assist with loosening stains on articles to be cleaned within the basket 122. For example, the heater may be positioned in contact with an outer surface of the wash tub 120, e.g., such that heat from the heater 300 transfers to wash liquid in the wash tub 120 by conduction through the wash tub 120, as illustrated in FIG. 2, or may be positioned in the wash tub 120, e.g., such that heat from the heater 300 transfers directly to wash liquid in the wash tub 120. In embodiments where heater 300 is positioned at the outer surface of the wash tub 120, the wash tub 120 may advantageously include materials having a high thermal conductivity, e.g., one or more metal materials, such as stainless steel. In embodiments where the heater 300 is positioned in the wash tub 120, the heater 300 may include a heating element and a waterproof or water-resistant coating or housing on or surrounding the heating element.

It should be appreciated that the present subject matter is not limited to any particular style, model, or configuration of washing machine appliance. The exemplary embodiment depicted in FIGS. 1 and 2 is simply provided for illustrative purposes only. While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. For example, different locations may be provided for the user interface, different configurations may be provided, e.g., vertical axis washing machines or combination washer-dryer appliances, and other differences may be applied as well.

Figure 3:
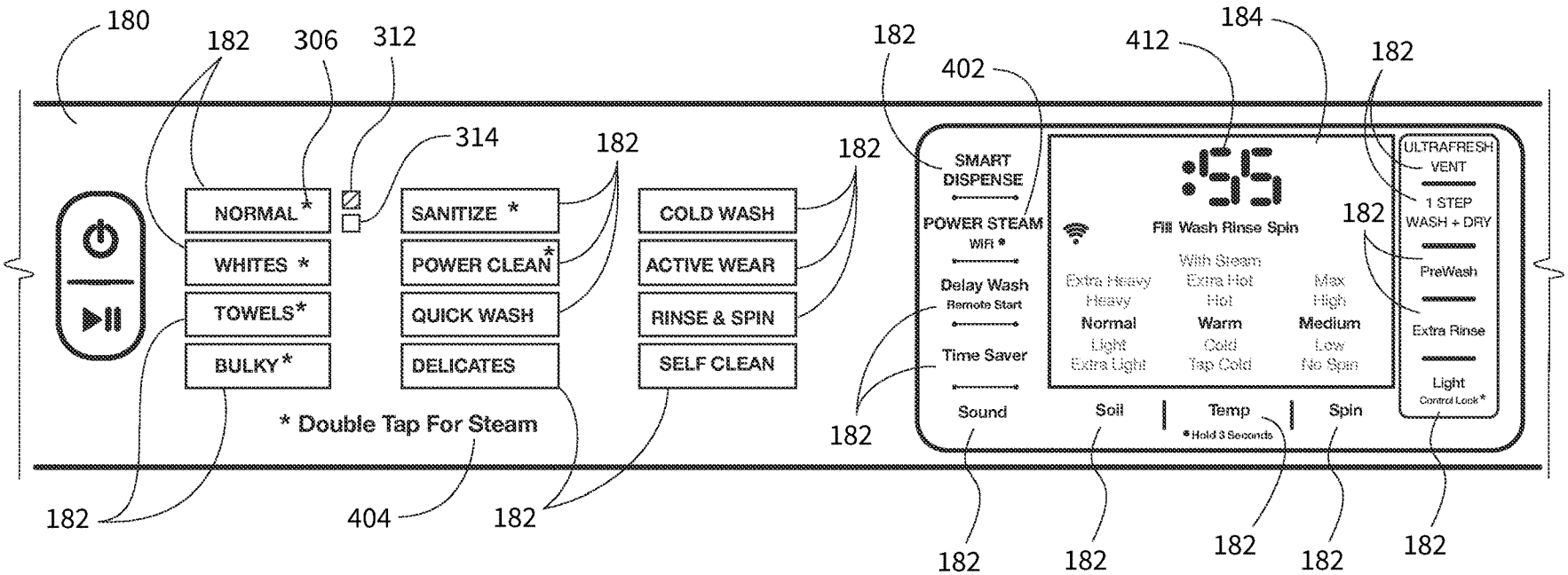
FIG. 3 provides a front view of an exemplary control panel for a washing machine appliance such as the exemplary washing machine appliance of FIGS. 1 and 2.
Figure 4:
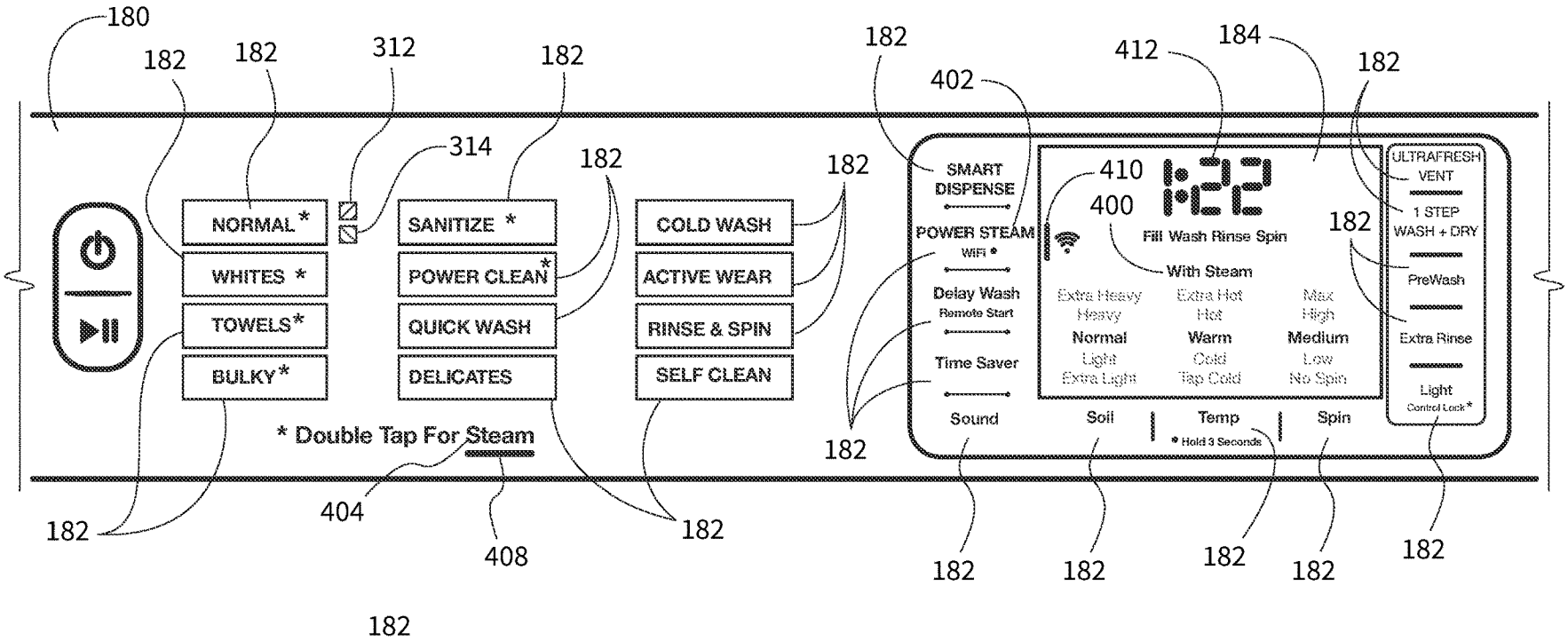
FIG. 4 provides another view of the exemplary control panel of FIG. 3.
Figure 5:
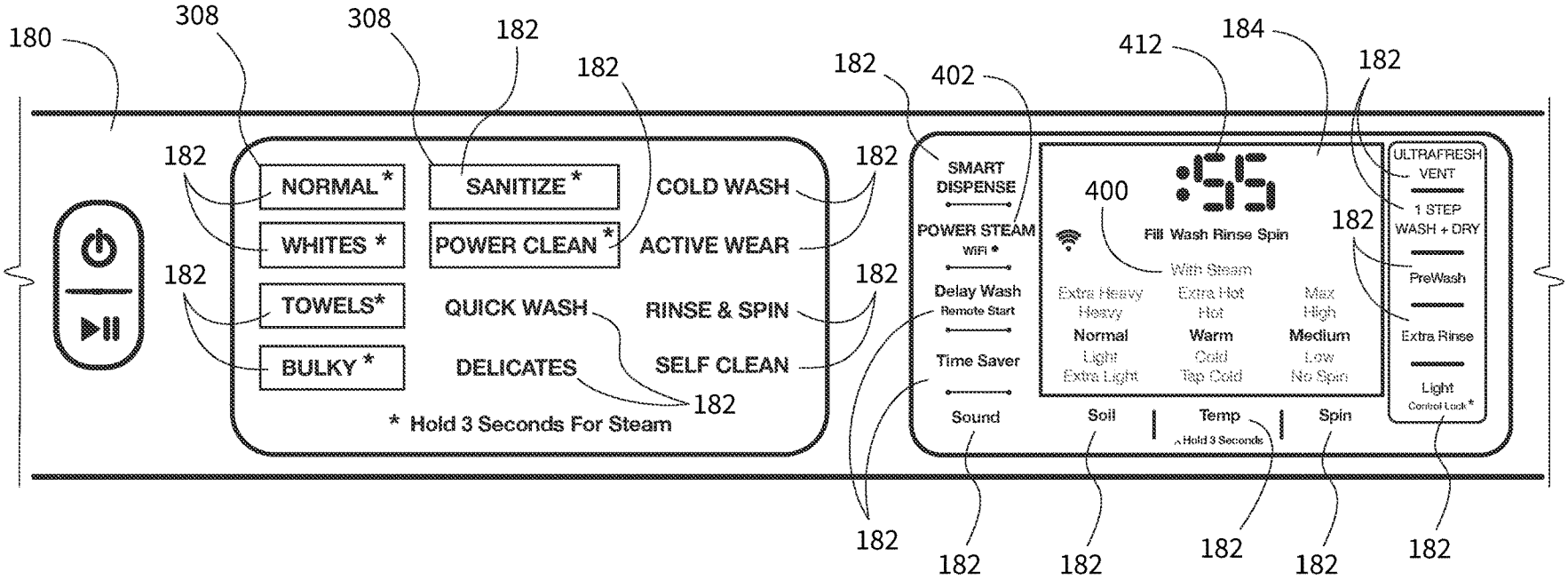
FIG. 5 provides a front view of another exemplary control panel for a washing machine appliance such as the exemplary washing machine appliance of FIGS. 1 and 2.
Figure 6:
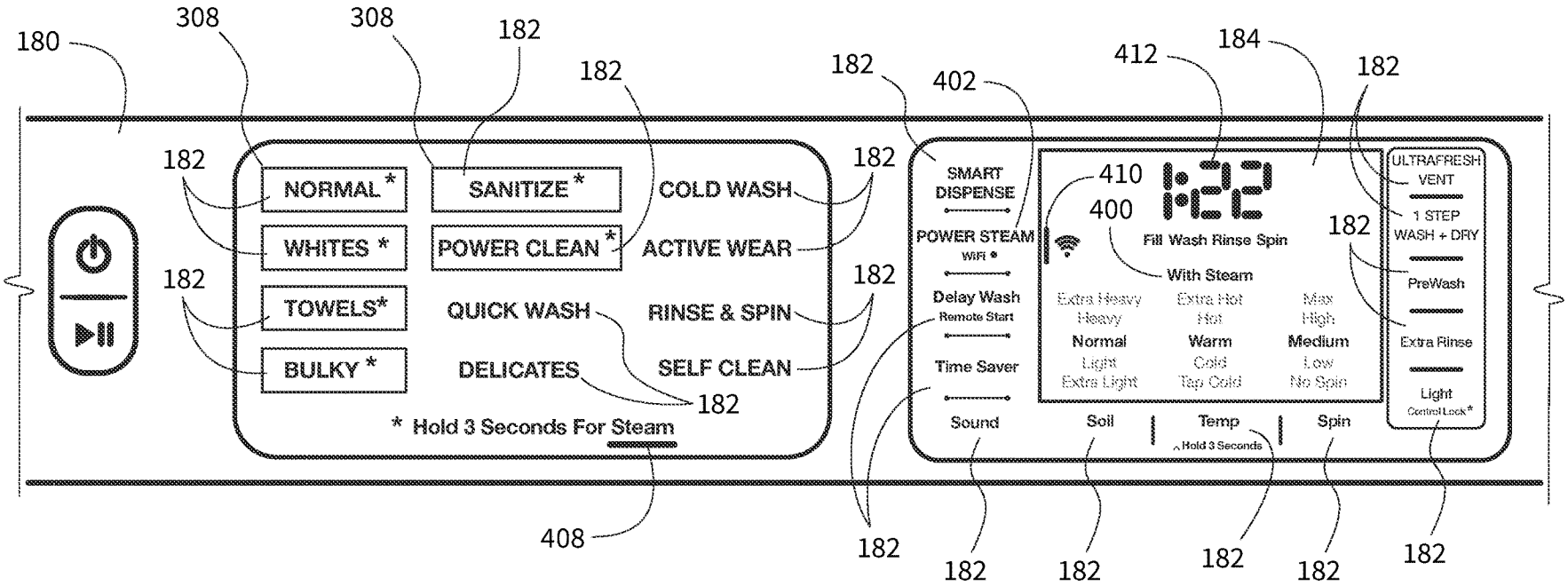
FIG. 6 provides another view of the exemplary control panel of FIG. 5.

FIGS. 3 through 6 illustrate exemplary embodiments of a control panel 180 for a washing machine appliance, such as the exemplary washing machine appliance 100 of FIGS. 1 and 2. FIGS. 3 and 5 illustrate the control panel 180 when a cycle is selected without a steam option. More particularly, the selected cycle in FIGS. 3 and 5 has a steam option available, but the steam option is not selected. The washing machine may have a plurality of selectable cycles and some of the selectable cycles may have an available steam option, while others may not. As illustrated in FIGS. 3 through 6, the selectable cycles may each have an associated input selector 182, e.g., a button or touch area (e.g., icon displayed on a touch-sensitive display screen), for selecting the respective one of the selectable cycles with which the input selector is associated. For example, one or more selectable cycles may also have a possible steam function, while remaining cycles of the plurality of selectable cycles do not have a steam option. In some embodiments, every cycle of the plurality of selectable cycles may have a selectable steam option available. FIGS. 4 and 6 illustrate the control panel 180 when a steam option is selected. In particular, the selectable cycles of the washing machine appliance may include, e.g., a "Normal" cycle, and the Normal cycle may be selectable by itself, e.g., without steam, or may be selected with steam, e.g., the Normal cycle may be selected and the steam option for the Normal cycle may also be selected. For example, a first touch input on the one input selector associated with the Normal cycle may select the Normal cycle without steam, and a second touch input on the one input selector associated with the Normal cycle may select the Normal cycle and select the steam option for the Normal cycle. In various embodiments, the first touch input and the second touch input may be a long press and a short press, a single press and a double press, or other similar sets of distinct touch inputs.

Each cycle selector, e.g., each cycle button, for a respective cycle which has a steam option available may be configured to output a cycle selection with or without a steam option based on the particular touch input received on the cycle selector. Thus, a single input selector, e.g., only one button or only one touch area, may be used to both select the desired cycle and to select the steam option for the desired cycle, when the steam option is available for the desired cycle. Accordingly, the steam option may be more easily selected, such as without having to use an additional input selector, e.g., pressing another button, to select the steam option in addition to pressing cycle selector button.

In embodiments where less than all of the selectable cycles include a steam option, the selectable cycles of the plurality of selectable cycles which do include a steam option may be grouped together. Such selectable cycles which include a steam option may also have distinct labels or additional labels to indicate the availability of the steam option for each respective cycle. For example, an asterisk 306 (FIGS. 3 and 4) or a highlight 308 (FIGS. 5 and 6) may be provided on the cycles for which a steam option is available. An indicator light 312, which may be a first indicator light, may be provided adjacent to or adjoining each cycle selector button, such that the indicator light may illuminate the cycle selector, e.g., button, or a portion thereof that corresponds to the selected cycle, and/or may illuminate an adjacent area on the control panel. For example, as illustrated in FIG. 3, indicator light 312 that corresponds to the "Normal" cycle, e.g., is proximate to the button for the Normal cycle, is illuminated to indicate the Normal cycle has been selected.

Referring now to FIG. 4, when the steam option is selected, one or more indicators may be provided to inform the user that the steam feature is activated or will be activated during the selected cycle. For example, one or more text steam indicators, such as "With Steam" or "Steam," may be provided on the control panel 180. In the example embodiment illustrated in FIG. 4, a first text steam indicator 400 is provided on the display 184, a second text steam indicator 402 is provided adjoining the display 184, and a third text steam indicator 404 is provided adjacent to the cycle selectors, e.g., below the cycle selectors. Such text steam indicators may be opaque or may be translucent, and some embodiments may include combinations of both opaque text steam indicators and translucent text steam indicators. Embodiments where one or more text steam indicators are provided may also include one or more indicator lights, such as LEDs, associated with the text steam indicator or each text steam indicator. As used herein, such indicator light(s) may be "associated with" the respective text steam indicator when the indicator light is positioned and oriented to emit light, e.g., visible light, to or towards an outer (front) surface of the control panel 180 at an area of the control panel 180 on which the text steam indicator is located and/or adjoining areas of the control panel 180 immediately adjacent to the area on which the associated text steam indicator is located.

For example, when the text steam indicator is translucent, the text steam indicator may be provided on an outer layer of the control panel 180, such as an outer layer of the display 184, and the associated indicator light may be positioned behind the text steam indicator (e.g., inward such as closer to the interior of the washing machine appliance), such as on an inner layer of the control panel 180 or the display 184 thereof, whereby light emitted from the indicator light shines through the associated text steam indicator, and may also illuminate one or more adjoining areas of the control panel around the text steam indicator. For example, the first text steam indicator 400 may be translucent, e.g., as illustrated in FIGS. 3 and 5 the first text steam indicator 400 is unilluminated, whereas in FIGS. 4 and 6 the first text steam indicator 400 is illuminated. As used herein, the "outer layer" and "inner layer" are defined relative to each other and with reference to the outside or inside of the washing machine appliance, e.g., such that outer layer is closer to the outside of the washing machine appliance than the inner layer, and vice versa. Moreover, such terms may be, but are not necessarily, superlative, e.g., the outer layer may be the outermost layer of the control panel or display, but is not necessarily the outermost layer.

As another example, in embodiments where the text steam indicator, or one of the text steam indicators, is opaque, the indicator light associated with the opaque text steam indicator may be positioned and oriented to emit light to or towards an area of the control panel adjoining the area of the control panel on which the opaque text steam indicator is positioned. For example, in some embodiments, the indicator light associated with the text steam indicator may be positioned below the text steam indicator or otherwise positioned and oriented to emit light towards an area of the control panel below the text steam indicator, such as third indicator light 408 in FIG. 4, which underlines the third text steam indicator 404. In some embodiments, the indicator light associated with the text steam indicator may be positioned next to the text steam indicator or otherwise positioned and oriented to emit light towards an area of the control panel laterally adjoining the text steam indicator, such as second indicator light 410 in FIG. 4, which illuminates an area of the control panel 180 next to, e.g., beside or laterally adjoining, the second text steam indicator 402.

In some embodiments, the one or more indicators which may be provided to inform the user that the steam feature is activated or will be activated during the selected cycle may also include one or more indicator lights adjoining each cycle selector, such as one or more indicator lights aligned with each cycle selector. For example, each of the selectable cycles which includes a steam option may have an indicator light 312 positioned next to the cycle selector for such cycle, and the indicator light 312 may be illuminated in a different way when the steam option is selected versus when the cycle is selected without the steam option. In addition or in alternative, a second indicator light 314 may be provided for each cycle with a steam option, and the second indicator light 314 may be illuminated when the steam option is selected. Illuminating the indicator light 312, or first indicator light, next to the cycle selector in a different way when the steam option is selected may include illuminating the indicator light 312 at a second intensity level and/or in a second color in response to a selected steam option. For example, in some embodiments, the indicator light 312 may get brighter or dimmer when the steam option is selected, or may change color when the steam option is selected, or may change both intensity and color. As another example, the indicator light 312 may be steadily illuminated for one of the selected cycle alone or the selected cycle with steam and may be intermittently illuminated, e.g., blink, for the other of the selected cycle alone or the selected cycle with steam. In some embodiments, the second indicator light 314 may be illuminated in response to a steam option selection, as well as or instead of illuminating the first indicator light 312 in a different way. In embodiments where the second indicator light 314 is provided, the second indicator light 314 may be similar to the first indicator light 312, or may be different, such as a different color.

In some embodiments, the control panel 180, e.g., the display 184 thereof, may include or be configured for providing a time display 412, e.g., a cycle time for a selected cycle. For example, as illustrated in FIGS. 3 through 6, the display 184 may include a display such as a seven-segment display for outputting a cycle time. In embodiments which include the time display, a first cycle time may be displayed for a selected cycle without a steam option (e.g., when the steam option is available but not selected) and a second cycle time may be displayed on the display in response to the selected cycle with the steam option. In the particular example illustrated in FIGS. 3 through 6, where the Normal cycle without steam is selected in FIGS. 3 and 5, a first cycle time for the Normal cycle is provided, which is fifty-five minutes in this example, whereas in FIGS. 4 and 6, the Normal cycle with steam is selected, and a second cycle time for the Normal cycle with steam is displayed, e.g., one hour and twenty two minutes in the illustrated example, it being understood that the cycle times illustrated in FIGS. 3 through 6 are provided by way of example only. Thus, in some embodiments, the different cycle time displayed may provide an indication that the steam option is selected or active, such as the changed cycle time may be an additional steam option indication provided in combination with one or more other indications as described herein.

The washing machine appliance may include a variety of input selectors 182. One input selector, e.g., one for each cycle, such as one for each cycle which includes a steam option, may be configured to output a cycle selection and a steam option selection, e.g., to the controller 186. For example, the same input selector may be configured to output the cycle selection only in response to a first input and to output the cycle selection and the steam option selection in response to a second, different, input at the same input selector. In some embodiments, the input selector for each cycle (which may also be referred to as a cycle selector) may be a touch-responsive input selector, such as a button, e.g., as illustrated in FIGS. 3 and 4, or a portion of a touchscreen, e.g., as illustrated in FIGS. 5 and 6.

As may be seen in FIGS. 3 through 6, the washing machine may have a plurality of selectable cycles, and each selectable cycle may have a cycle selector, e.g., an input selector associated with the respective cycle such that the respective cycle is to be performed when the associated input selector is manipulated, e.g., touched. Thus, the washing machine appliance, e.g., the control panel thereof, may include a plurality of cycle selectors in a one-to-one correspondence with the plurality of selectable cycles.

Figure 7:
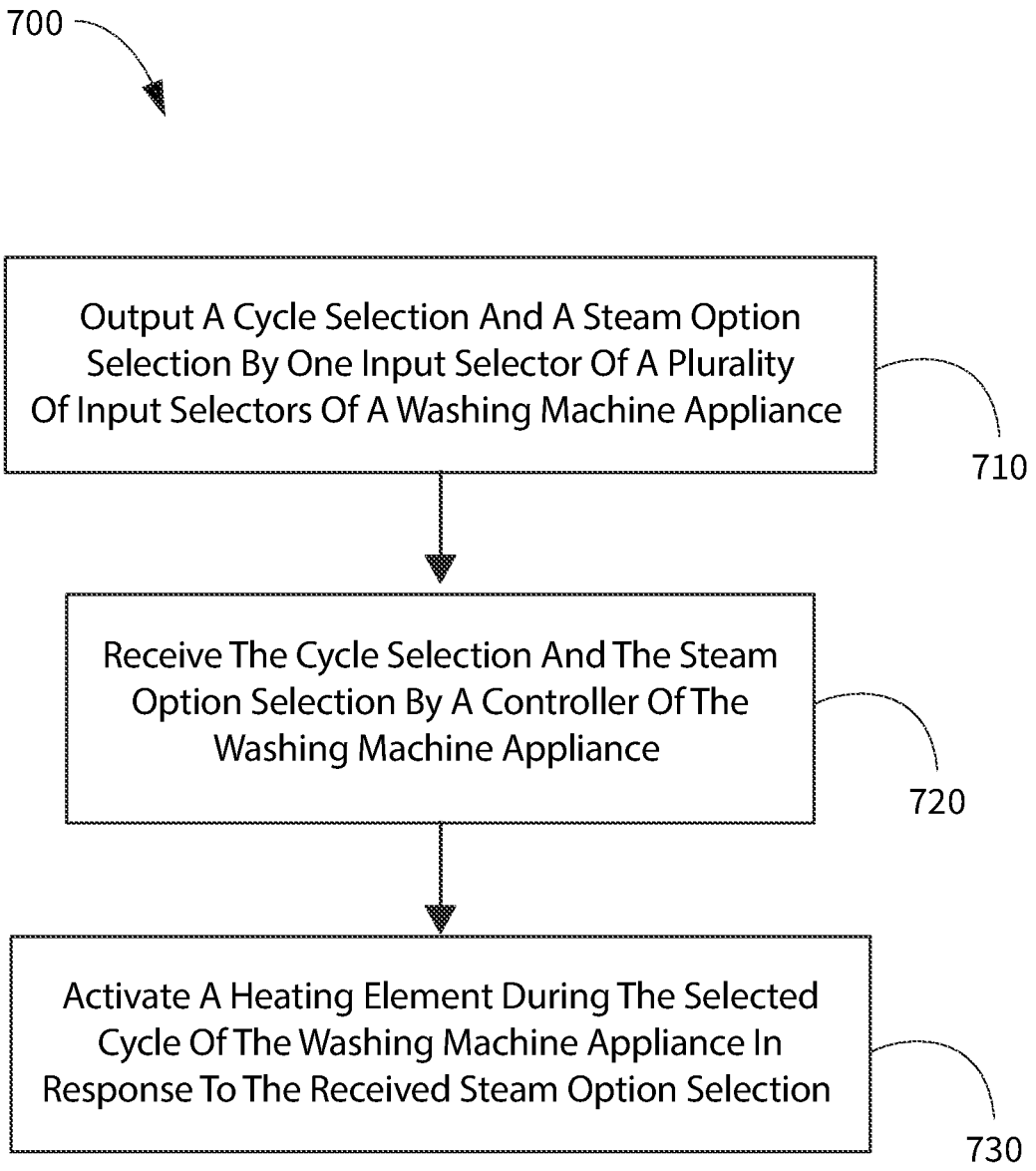
FIG. 7 provides a flow diagram of an exemplary method of operating a washing machine appliance according to one or more exemplary embodiments of the present disclosure.

FIG. 7 provides a flow diagram of an exemplary method 700 of operating a washing machine appliance, according to one or more exemplary embodiments of the present disclosure. Method 700 may be implemented using any suitable appliance, including, for example, horizontal axis washing machine appliance 100 of FIGS. 1 and 2. Accordingly, to provide context to method 700, reference numerals utilized to describe the features of washing machine appliance 100 in FIGS. 1 and 2 will be used below.

Method 700 may be implemented using any suitable appliance, such as a washing machine appliance which includes a cabinet, a wash tub positioned within the cabinet, a wash basket rotatably mounted within the wash tub, a heating element in thermal communication with the wash tub whereby the heating element is positioned and configured to generate steam within the wash tub, and a control panel that includes a plurality of input selectors and a display.

As illustrated in FIG. 7, the method 700 may include a step 710 of outputting a cycle selection and a steam option selection by one input selector of the plurality of input selectors and a step 720 of receiving the cycle selection and the steam option selection by a controller of the washing machine appliance.

Method 700 may also include performing the selected cycle, and various exemplary cycles which may be performed may include operations such as filling the tub with wash liquid, rotating the basket and/or an agitator, and other such operations, such as the agitation phase, spin cycles, etc. described above. In response to the received steam option selection, the method 700 may include activating the heating element during the selected cycle of the washing machine appliance, e.g., as indicated at 730 in FIG. 7.

In some embodiments, the one input selector may be a touch-responsive input selector. In such embodiments, the one input selector may be configured to output a cycle selection without steam in response to a first touch input and may be configured to output the cycle selection and the steam option selection in response to a second touch input. For example, the first touch input may be a single touch and the second touch input may be a double touch, such as two touch inputs within a short time span of each other, e.g., the double touch may include two touch inputs within two seconds or less, such as within one second, of each other. As another example, the first touch input may be a short press, e.g., a press of about two seconds or less, such as about one second or less, and the second touch input may be a long press, e.g., a touch of between about two seconds and about five seconds, such as about three seconds.

As mentioned above, the touch-responsive input selector may include a touchscreen (e.g., FIGS. 5 and 6) or may include a button (e.g., FIGS. 3 and 4). In embodiments where the touch-responsive input selector includes a touchscreen, outputting the cycle selection and the steam option selection may include outputting the cycle selection and the steam option selection in response to a touch on the touchscreen. In embodiments wherein the touch-responsive input selector includes a button, outputting the cycle selection and the steam option selection may include outputting the cycle selection and the steam option selection in response to the button being pressed.

In some embodiments, the washing machine appliance may include an indicator light, such as an indicator light on the control panel, such as adjacent to a cycle selector for the selectable cycle. For example, the control panel may include one or more indicator lights associated with the selected cycle. In such embodiments, method 700 may also include illuminating the one or more indicator lights associated with the selected cycle in a first way in response to a selected cycle without a steam option and illuminating the one or more indicator lights associated with the selected cycle in a second way in response to the cycle selection and the steam option selection. For example, illuminating the one or more indicator lights associated with the selected cycle in the first way may include illuminating the indicator light of the control panel at a first intensity level in response to a selected cycle without a steam option and illuminating the one or more indicator lights associated with the selected cycle in the second way may include illuminating the indicator light at a second intensity level in response to a selected steam option. For example, with reference to the first and second touch inputs described above, the indicator light may be illuminated at a first brightness level in response to the first touch input, to indicate the selected cycle without steam, and may be illuminated at a second brightness different from the first brightness, e.g., brighter or dimmer, in response to the second touch input to indicate the cycle selection and the steam option selection.

As another example in embodiments where the washing machine appliance includes an indicator light, illuminating the one or more indicator lights associated with the selected cycle in the first way may also or instead include illuminating an indicator light of the control panel in a first color in response to a selected cycle without a steam option and illuminating the one or more indicator lights associated with the selected cycle in the second way may include illuminating the indicator light in a second color in response to a selected steam option. Again with reference to the examples described above including the first touch input and the second touch input, the indicator light may be illuminated in a first color in response to the first touch input, to indicate the selected cycle without steam, and may be illuminated in a second color different from the first color in response to the second touch input to indicate the cycle selection and the steam option selection.

In some embodiments, the washing machine appliance may include multiple indicator lights, such as multiple indicator lights for each selectable cycle, e.g., each selectable cycle which has an available steam option. In such embodiments, illuminating the one or more indicator lights associated with the selected cycle in the first way may include illuminating a first indicator light of the control panel in response to a selected cycle without a steam option and illuminating the one or more indicator lights associated with the selected cycle in the second way may include illuminating a second indicator light of the control panel in response to the selected steam option.

In some embodiments, the washing machine appliance may include one or more text steam indicators. In such embodiments, the method 700 may include activating an indicator light associated with the text steam indicator of the control panel in response to the received steam option selection. For example, one or more text steam indicators may be located on the display and/or adjacent to a cycle name label on the control panel. In some embodiments, the text steam indicator may be translucent. In such embodiments, the indicator light associated with the text steam indicator may be positioned behind the translucent text steam indicator, and activating the indicator light associated with the text steam indicator may include and/or may result in illuminating the text steam indicator, e.g., light from the associated indicator light may shine through the translucent text steam indicator.

As another example, some exemplary embodiments may include outputting a cycle time, such as an estimated cycle time, for a currently selected cycle and/or an active cycle. In such embodiments, the method 700 may include outputting a first cycle time on the display in response to a selected cycle without a steam option and outputting a second cycle time on the display in response to the selected cycle with the steam option.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub positioned within the cabinet;

a wash basket rotatably mounted within the wash tub;

a heating element in thermal communication with the wash tub whereby the heating element is positioned and configured to generate steam within the wash tub;

a control panel, the control comprising a plurality of input selectors and a display, wherein one input selector of the plurality of input selectors is configured to output a cycle selection and a steam option selection; and a controller, the controller configured for:

receiving, from the one input selector of the plurality of input selectors, the cycle selection and the steam option selection, wherein the steam option selection is an affirmative selection; and activating the heating element whereby steam is generated within the wash tub during the selected cycle of the washing machine appliance in response to the received steam option selection.

2. The washing machine appliance of claim 1, wherein the plurality of input selectors are provided on a touch-responsive interface, wherein the one input selector is configured to output a cycle selection without steam in response to a first touch input on the one input selector and is configured to output the cycle selection and the steam option selection in response to a second touch input on the one input selector.

3. The washing machine appliance of claim 2, wherein the first touch input is a short press on the one input selector and the second touch input is a long press on the one input selector.

4. The washing machine appliance of claim 2, wherein the first touch input is a single touch on the one input selector and the second touch input is a double touch on the one input selector.

5. The washing machine appliance of claim 2, wherein the touch-responsive interface comprises a touchscreen.

6. The washing machine appliance of claim 2, wherein the touch-responsive interface comprises a plurality of buttons.

7. The washing machine appliance of claim 1, wherein the control panel further comprises one or more indicator lights associated with the selected cycle, the controller configured to illuminate the one or more indicator lights associated with the selected cycle in a first way in response to a selected cycle without a steam option and to illuminate the one or more indicator lights associated with the selected cycle in a second way in response to the cycle selection and the steam option selection.

8. The washing machine appliance of claim 1, wherein the control panel further comprises a text steam indicator, the controller configured to activate an indicator light associated with the text steam indicator in response to the cycle selection and the steam option selection.

9. The washing machine appliance of claim 8, wherein the text steam indicator is translucent, the indicator light associated with the text steam indicator positioned behind the text steam indicator, whereby activating the indicator light associated with the text steam indicator illuminates the text steam indicator.

10. The washing machine appliance of claim 1, wherein the controller is further configured to output a first cycle time on the display in response to a selected cycle without a steam option and to output a second cycle time on the display in response to the cycle selection and the steam option selection.

11. A method of operating a washing machine appliance, the washing machine appliance comprising a cabinet, a wash tub positioned within the cabinet, a wash basket rotatably mounted within the wash tub, a heating element in thermal communication with the wash tub whereby the heating element is positioned and configured to generate steam within the wash tub, and a control panel, the control comprising a plurality of input selectors and a display, the method comprising:

outputting, by one input selector of the plurality of input selectors, a cycle selection and a steam option selection, wherein the steam option selection is an affirmative selection;

receiving, by a controller of the washing machine appliance, the cycle selection and the steam option selection; and activating the heating element whereby steam is generated within the wash tub during the selected cycle of the washing machine appliance in response to the received steam option selection.

12. The method of claim 11, wherein the plurality of input selectors are provided on a touch-responsive interface, wherein the one input selector is configured to output a cycle selection without steam in response to a first touch input on the one input selector and is configured to output the cycle selection and the steam option selection in response to a second touch input on the one input selector.

13. The method of claim 12, wherein the first touch input is a short press on the one input selector and the second touch input is a long press on the one input selector, and wherein outputting the cycle selection and the steam option selection comprises outputting the cycle selection and the steam option selection in response to the long press on the one input selector.

14. The method of claim 12, wherein the first touch input is a single touch on the one input selector and the second touch input is a double touch on the one input selector, and wherein outputting the cycle selection and the steam option selection comprises outputting the cycle selection and the steam option selection in response to the double touch on the one input selector.

15. The method of claim 12, wherein the touch-responsive interface comprises a touchscreen, wherein outputting the cycle selection and the steam option selection comprises outputting the cycle selection and the steam option selection in response to a touch on the touchscreen.

16. The method of claim 12, wherein the touch-responsive interface comprises a plurality of buttons, wherein the one input selector is a button, wherein outputting the cycle selection and the steam option selection comprises outputting the cycle selection and the steam option selection in response to the button being pressed.

17. The method of claim 11, wherein the control panel further comprises one or more indicator lights associated with the selected cycle, the method further comprising illuminating the one or more indicator lights associated with the selected cycle in a first way in response to a selected cycle without a steam option and illuminating the one or more indicator lights associated with the selected cycle in a second way in response to the cycle selection and the steam option selection.

18. The method of claim 11, wherein the control panel further comprises a text steam indicator, the method further comprising activating an indicator light associated with the text steam indicator in response to the cycle selection and the steam option selection.

19. The method of claim 18, wherein the text steam indicator is translucent, the indicator light associated with the text steam indicator positioned behind the text steam indicator, whereby activating the indicator light associated with the text steam indicator illuminates the text steam indicator.

20. The method of claim 11, further comprising outputting a first cycle time on the display in response to a selected cycle without a steam option and outputting a second cycle time on the display in response to the cycle selection and the steam option selection.

* * * * *